US009869967B2

(12) United States Patent
Suzuki

(10) Patent No.: US 9,869,967 B2
(45) Date of Patent: Jan. 16, 2018

(54) IMAGE FORMING APPARATUS

(71) Applicant: CANON KABUSHIKI KAISHA, Tokyo (JP)

(72) Inventor: Takayuki Suzuki, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/074,074

(22) Filed: Mar. 18, 2016

(65) Prior Publication Data

US 2016/0274535 A1 Sep. 22, 2016

(30) Foreign Application Priority Data

Mar. 18, 2015 (JP) ..... 2015-054467

(51) Int. Cl.
*G03G 21/16* (2006.01)
*G03G 15/08* (2006.01)

(52) U.S. Cl.
CPC ..... *G03G 21/1676* (2013.01); *G03G 15/0872* (2013.01); *G03G 21/1647* (2013.01); *G03G 2215/0129* (2013.01); *G03G 2215/0678* (2013.01)

(58) Field of Classification Search
None
See application file for complete search history.

(56) References Cited

U.S. PATENT DOCUMENTS

| | | | | |
|---|---|---|---|---|
| 6,947,690 | B2 | 9/2005 | Tazawa et al. | |
| 8,639,164 | B2 | 1/2014 | Kuge et al. | |
| 2015/0063873 | A1* | 3/2015 | Tanisawa ..... | G03G 15/0872 399/258 |

FOREIGN PATENT DOCUMENTS

| | | | |
|---|---|---|---|
| JP | 2002-072829 | A | 3/2002 |
| JP | 2004-138694 | A | 5/2004 |
| JP | 2007-249165 | A | 9/2007 |
| JP | 2009-294407 | A | 12/2009 |
| JP | 2011-128230 | A | 6/2011 |
| JP | 2014-202930 | A | 10/2014 |

* cited by examiner

*Primary Examiner* — Thomas Giampaolo, II
(74) *Attorney, Agent, or Firm* — Fitzpatrick, Cella, Harper & Scinto

(57) ABSTRACT

An image forming apparatus includes a mounting portion on which a toner container provided with an accommodating portion configured to accommodate toner is mountable; and an opening connectable with an opening provided in the toner container to be in fluid communication with the toner accommodating portion when the toner container is mounted to the mounting portion. The mounting portion is provided with a rib extending in a mounting direction in which the toner container is mounted to the mounting portion and configured to guide a bottom surface of the toner container in the mounting direction, the rib including a plurality of sets of alternating peak and valley arranged along a longitudinal direction of the rib.

25 Claims, 12 Drawing Sheets

IMAGE FORMING APPARATUS

FIELD OF THE INVENTION AND RELATED ART

The present invention relates to an image forming apparatus which is represented by a copying machine, a printing machine, and the like.

In the field of an image forming apparatus, toner has been substantially reduced in particle size, in order to improve an image forming apparatus in image quality, in particular, in terms of detail. Ordinarily, toner is placed in a toner container, from which it is supplied to a developing device in an image forming apparatus. Thus, an image forming apparatus and the toner container therefor are structured so that the area of contact between the apparatus and toner container remains sealed, in order to prevent toner from leaking from the area of connection. However, as toner is reduced further in particle size, the possibility that toner will leak through minute gaps which are present in the area of connection between the main assembly of an image forming apparatus and the toner container therefor has become higher.

Further, as toner is supplied to a developing device through the toner outlet of a toner container, a certain amount of toner temporarily remains afloat in the adjacencies of the outlet. Moreover, the smaller in particle size the toner, the less likely for the toner to settle. Therefore, it is likely for toner to scatter into the adjacencies of the toner outlet of a toner container in an image forming apparatus, when the toner container is replaced.

A toner container is likely to be replaced by a user. Generally speaking, a toner container is shorter in life expectancy than the main assembly of an image forming apparatus. Therefore, it is likely for the toner container in the main assembly of an image forming apparatus to be replaced multiple times during the life expectancy of the image forming apparatus. As described above, when a toner container in an image forming apparatus is replaced, toner scatters in the apparatus, sometimes soiling the toner container, although the amount by which toner scatters is rather small. Further, it is the surface of a toner container that a user is likely to directly touch when the user replaces the toner container in the apparatus. Therefore, it is possible that the soiling of the surface of a toner container in an image forming apparatus by the toner from the toner container will reduce the apparatus in terms of toner container replaceability.

There is disclosed in Japanese Laid-open Patent Application No. 2004-138694 (patent document 1), an image forming apparatus which internally holds a toner container. In the case of this image forming apparatus, as toner is consumed by development, its developing device is replenished with the toner from the toner container. Further, the inward surface of the toner container holding section of the apparatus plays the role of supporting a toner container, in the main assembly of the apparatus, and also, the role of guiding the toner container when the toner container is installed into the main assembly. Thus, if toner scatters from the toner outlet of the toner container, it adheres to the inward surface of the toner container holding section of the image forming apparatus, making it possible that the outward surface of the toner container will be soiled by the toner on the inward surface of the toner container supporting section.

In the case of the image forming apparatus disclosed in Japanese Laid-open Patent Application No. 2011-128230 (patent document 2), it is provided with a two-layer shutter which is for preventing the toner, having adhered to the toner outlet of the toner container in the apparatus, from falling in the apparatus.

In the case of the image forming apparatus disclosed in Japanese Laid-open Patent Application No. 2007-249165, it is provided with a toner catching section, which is positioned below the door of the toner container holding section, to prevent the toner having adhered to the outward surface of the toner container from falling outside the apparatus.

SUMMARY OF THE INVENTION

Thus, the primary object of the present invention is to provide an image forming apparatus which does not soil a toner container, and yet, is superior in appearance and operability, and also, lower in cost, than any conventional image forming apparatus.

According to an aspect of the present invention, there is provided an image forming apparatus comprising a mounting portion on which a toner container provided with an accommodating portion configured to accommodate toner is mountable; and a connecting portion including an opening connectable with an opening provided in the toner container to be in fluid communication with the toner accommodating portion when the toner container is mounted to said mounting portion, wherein said mounting portion is provided with a rib extending in a mounting direction in which the toner container is mounted to said mounting portion and configured to guide a bottom surface of the toner container in the mounting direction, said rib including a plurality of sets of alternating peak and valley arranged along a longitudinal direction of said rib.

Further features of the present invention will become apparent from the following description of exemplary embodiments with reference to the attached drawings.

DESCRIPTION OF THE EMBODIMENTS

Hereafter, the present invention is described, based on preferred embodiments of the present invention, with reference to appended drawings. These embodiments are not intended to limit the present invention in scope in terms of measurements, materials, shapes of the structural components of an image forming apparatus, and the positioning of the structural components relative to each other, unless specifically noted.

Embodiment 1

Image Forming Apparatus

Figure 1:
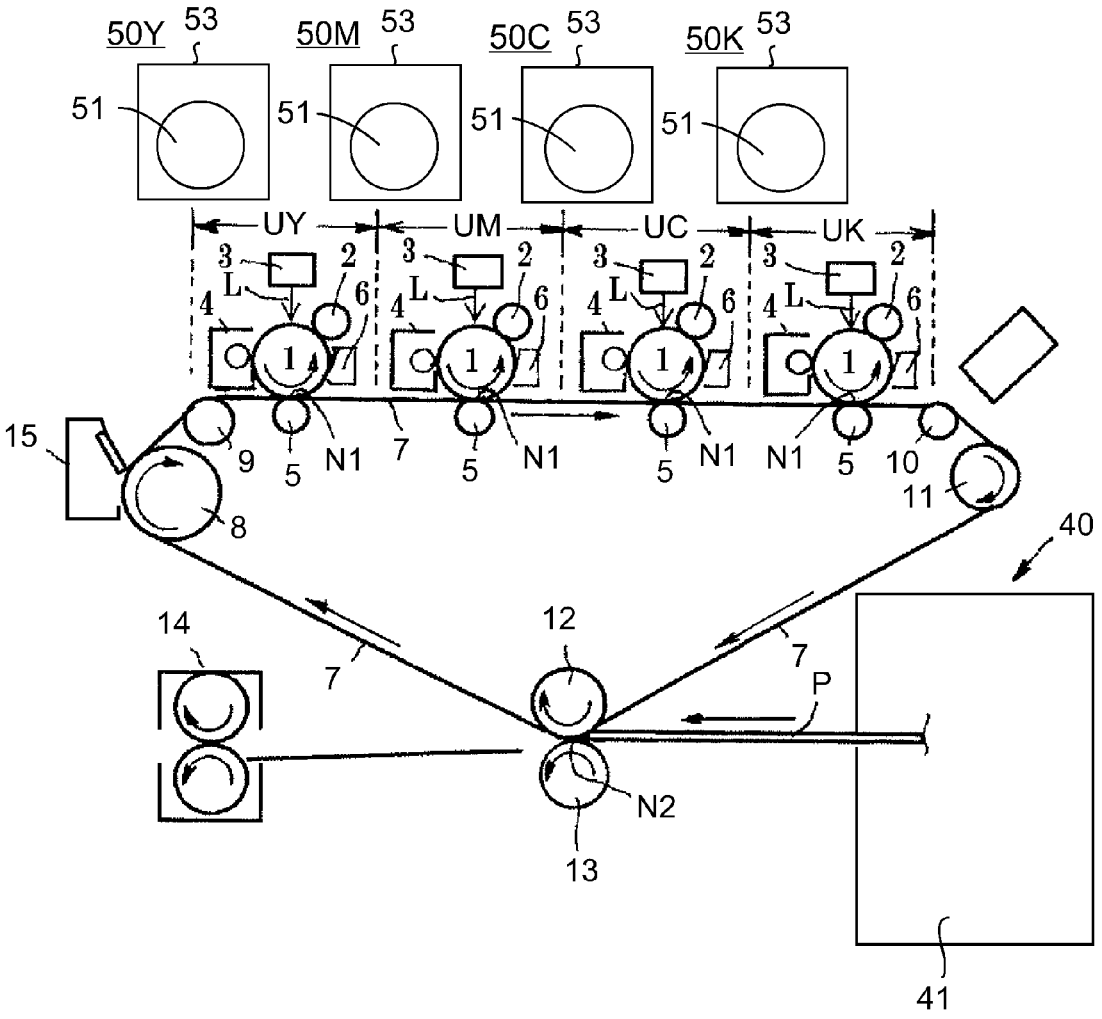
FIG. 1 is a schematic sectional view of the image forming apparatus in the first embodiment of the present invention, which shows the internal mechanism of the apparatus.

FIG. 1 is a schematic sectional view of the main assembly (main assembly: unshown) of the image forming apparatus in this embodiment. It shows the general structure of the internal mechanism of the apparatus. More specifically, it shows the general structure of an electrophotographic full-color image forming apparatus, which is of the so-called tandem type. The image forming method of this apparatus is based on four primary color components. It has four image forming sections U (UY, UM, UC and UK), which form yellow (Y), magenta (M), cyan (C) and black (K) toner images, respectively, on their image bearing component. Yellow, magenta and cyan colors are three primary color components into which an image to be formed can be separated.

Each image forming section U has an electrophotographic photosensitive component 1 (which hereafter will be referred to as drum due to its shape), and electrophotographic processing means for processing the drum 1. The drum 1 is an image bearing component. It is rotationally driven in the counterclockwise direction indicated by an arrow mark. The electrophotographic processing means include: a charge roller 2; an exposing device 3 which outputs a beam L of laser light while modulating the beam L according to the information of the image to be formed; a developing device 4; a primary transfer roller 5; a drum cleaner 6; etc. Further, the image forming apparatus has an intermediary transfer belt 7, which is endless (which hereafter will be referred to simply as belt 7). The belt 7 is suspended and kept tensioned by multiple rollers 8-12. It is circularly driven in the clockwise direction indicated by an arrow mark.

In the four image forming sections U, yellow (Y), magenta (M), cyan (C) and black toner images are formed on the photosensitive drums 1, one for one. Then, the four toner images are sequentially transferred in layers onto the surface of the belt 7, in the primary transfer nip N1 which each of the four image forming sections has. As a result, a full-color toner image is effected by the four monochromatic toner images, different in color, layered on the belt 7. By the way, the electrophotographic process carried out in each image forming section U, and the operation of each process means, have been well known. Therefore, they are not described here.

A referential code 13 stands for a secondary transfer roller, which forms a secondary transfer nip N2 by being pressed against the roller 12, with the presence of the belt 7 between itself and roller 12. A sheet P of recording medium is conveyed to the secondary transfer nip N2 from a recording medium feeding-conveying section (unshown). Then, it is introduced in to the nip N2 with a preset control timing, and is conveyed through the nip N2. While the sheet P is conveyed through the nip N2, the toner images on the belt 7 are transferred together (secondary transfer) onto the surface of the sheet P. After the conveyance of the sheet P through the nip N2, the sheet P is separated from the belt 7. Then, it is introduced into a fixing device 14, in which the toner images are fixed to the sheet P with the application of heat and pressure. Then, the sheet P is discharged as a full-color print from the main assembly of the image forming apparatus.

The primary transfer residual toner, which is the toner remaining on the peripheral surface of the photosensitive drum 1 after the primary transfer of a toner image onto the belt 7 in each image forming section U, is removed by the drum cleaner 6. The toner in each drum cleaner 6 is conveyed by a waste toner conveying device 43 (FIGS. 12 and 13) to a waste toner container 41 (box), which is in the waste toner holding section 40 of the main assembly of the image forming apparatus, and is collected in the waste toner container 41. The secondary transfer residual toner, which is the toner remaining on the belt 7 after the secondary transfer of the toner images onto a sheet P of recording medium, is removed by the belt cleaner 15. The waste toner in the belt cleaner 15 is conveyed to the waste toner container 41 by the waste toner conveying device 43, and is collected in the waste toner container 41.

(Toner Supplying Device)

With the continuation of an image forming operation, the toner in the developing device 4 in each image forming section U is gradually consumed. A toner supplying device (toner supplying section) is a device for replenishing the developing device 4 with toner by an amount which is equal to the amount by which toner was consumed for image formation. It is in the main assembly of the image forming apparatus. Referential codes 50Y, 50M, 50C and 50K stand for toner supplying devices for replenishing the developing devices 4 in the image forming sections UY, UM, UC and UK, with yellow, magenta, cyan and black toners, respectively. The toner supplying devices 50Y, 50M, 50C and 50K are the same in structure. Thus, only one of them is described.

Figure 14:
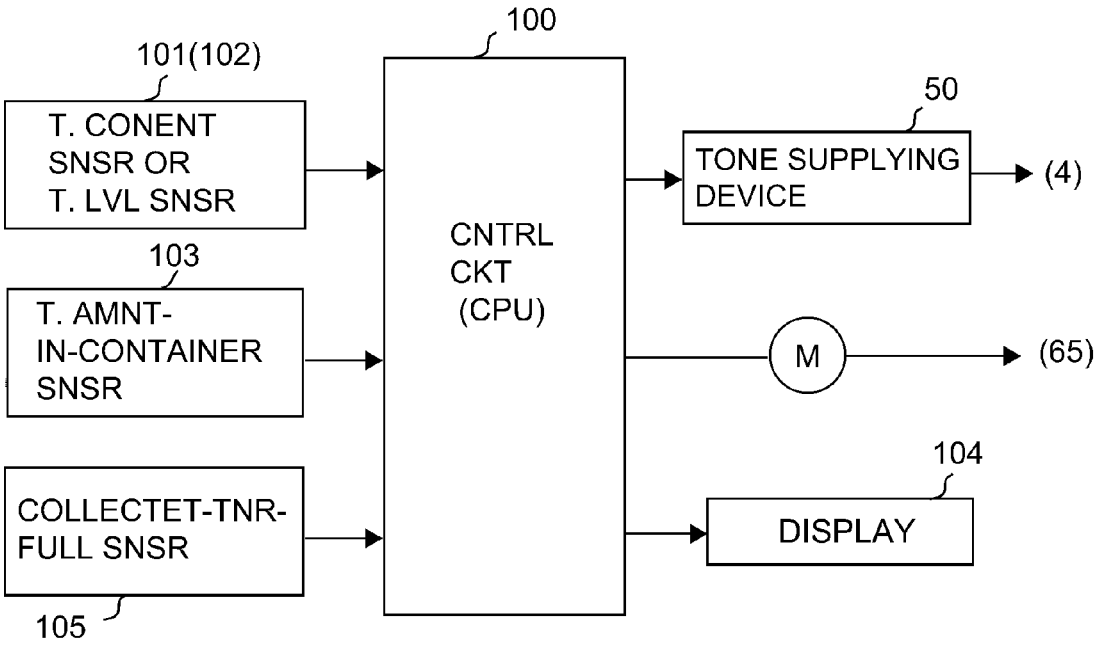
FIG. 14 is a block diagram of the control system of the image forming apparatus which is in accordance with the present invention.

In a case where the developing device 4 is such a developing device that uses two-component developer, the developing device 4 is provided with a toner density sensor 101 (FIG. 14), which measures the toner density in the developing device 4, and the output of which is inputted into the control circuit section 100. The control circuit section 100 controls the amount by which toner is supplied from the toner supplying device 50 to the developing device 4, in such a manner that the inputted sensor output remains in a preset toner density range.

In a case where the developing device 4 is such a developing device that uses singe-component developer, the developing device 4 is provided with a toner level sensor 102 (FIG. 14), the output of which is inputted into the control circuit section 100. The control circuit section 100 controls the amount by which the developing device 4 is replenished with toner by the toner supplying device 50, in such a manner that the inputted sensor output remains in a preset toner level range.

By the way, regarding the orientation of the image forming apparatus, orientation of the main assembly of the apparatus, and orientation of the toner supplying device 50, the front side is the side from which a toner container 51 (toner cartridge) which contains replenishment toner is inserted into, or extracted from, the toner container holding section 53 of the toner supplying device 50. The rear side (back side) is the opposite side from the front side. The frontward direction is the rear-to-front direction, and the rearward direction is the opposite direction from the frontward direction. The left or right side of the apparatus main assembly, or toner supplying device 50, are the left or right side thereof when viewed from the front side. Further, the top or bottom side is the top or bottom side in terms of the gravity direction.

Figure 2:
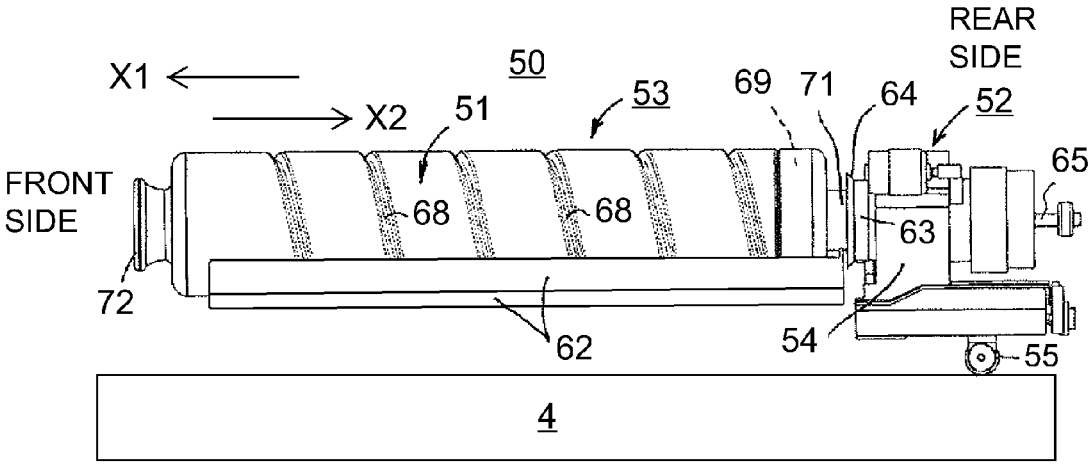
FIG. 2 is a right-side view of the toner supplying section of the image forming apparatus.
Figure 3:
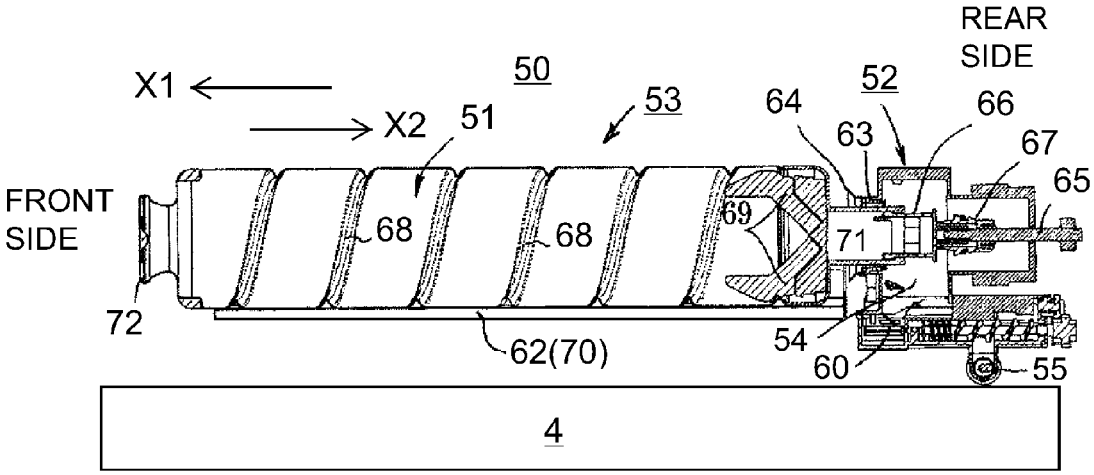
FIG. 3 is a sectional view of the toner supplying section, at a vertical plane which coincides with the axial line of the toner container, as seen from the right-side of the apparatus.

FIG. 2 is a right side view of the toner supplying device 50. FIG. 3 is also a right side view of the toner supplying device 50, except that the right side of the drawing is a sectional view of the rear end portion of the toner supplying device 50. The toner supplying device 50 has a toner container holding section 53 (toner container holder), in which the toner container 51 is removably installable. The toner supplying device 50 also has a toner reserving section 52, which is a part of the toner supplying mechanism of the main assembly, and a toner conveying section 55, which is also a part of the toner supplying mechanism of the main assembly, and conveys the toner in the toner reserving section 52. It is the toner supplying mechanism of the main assembly to which the toner container 51 is connected.

The toner reserving section 52 is in the apparatus main assembly. It is on the rear side of the apparatus main assembly, and is above the developing device 4. Referring to FIG. 3, the toner reserving section 52 has a buffer section 54, which temporarily holds toner as toner is supplied from the toner container 51, and a toner conveying section 55, which conveys the toner in the buffer section 54 to the developing device 4. The buffer section 54 is provided with a stirring component which periodically stirs the toner in the buffer section 54 to prevent the toner from agglomerating. The toner conveying section 55 is driven by the control circuit section 100 so that the toner in the buffer section 54 is conveyed to the developing device 4 by an amount which corresponds to the amount by which toner was consumed by the developing device 4.

(1) Toner Container Holding Section

Next, the toner container holding section 53 is described in detail. In this embodiment, the toner container 51, in which toner is present, is installed into the toner container holding section 53 so that the developing device 4 is directly replenished with toner from the toner container 51 as necessary, when the developing device 4 needs to be replenished with toner. There are other methods for replenishing the developing device 4 with toner, than the one used in this embodiment. According to one of the other methods, a toner reserving section, in which toner is temporarily stored, is provided within the apparatus main assembly so that as the toner reserving section reduces in the amount of residual toner therein, only toner is supplied to the toner reserving section from a toner container 51, and then, the toner container 51 is recovered.

Referring to FIG. 2, the toner container holding section 53 is placed in the apparatus main assembly. It is positioned roughly level with the toner reserving section 52. Further, it is positioned between the front wall of the apparatus main assembly and the toner reserving section 52. The front wall of the apparatus main assembly is provided with an opening (unshown), which is next to the front end of the toner container holding section 53. Further, the front wall is provided with a door (unshown) for covering, or exposing, the opening. When a user wants to install a toner container 51 into the apparatus main assembly (toner container holding section 53), or extract the toner container 51 from the apparatus main assembly, the user is to open the door to expose the opening, and then, to install or extract the toner container 51 through the exposed opening.

Concretely, the toner container 51 is to be installed into the toner container holding section 53 in the following manner. First, a user is to open the door. As the door is opened, the opening, which is next to the front end of the toner container holding section 53, is exposed. Then, the user is to insert the toner container 51 into the toner container holding section 53, in such an attitude that the lengthwise end of the toner container 51, which has a cylindrical toner outlet 71 (first opening), and a movable cap as a sealing component for the cylindrical toner outlet 71, is positioned downstream in terms of the direction of insertion. Then, the user is to position the toner container 51 so that the bottom side of the toner container 51 is caught by the toner container guiding section 62, which makes up the bottom wall of the toner container holding section 53. Then, the user is to slide the toner container 51 in the rearward direction X2 (installation direction) on the toner container guiding section 62 so that the toner container 51 is guided by the toner container guiding section 62.

As the toner container 51 is pushed deeper into the toner container holding section 53, it is caught by a stopper section (unshown) of the apparatus main assembly, being thereby prevented from being slid further inward. That is, the toner container 51 is properly positioned in the toner container holding section 53.

With the toner container 51 being positioned as described above in the toner container holding section 53, the combination of the cylindrical outlet 71 and cap 66, which makes up the downstream end portion of the toner container 51 in terms of the toner container insertion direction, will have entered the toner reserving section 52 through the opening 62 (second opening) of the toner reserving section 52, by a preset distance (FIGS. 2 and 3). That is, the cylindrical outlet 71 will have been connected to the toner inlet 63 in a preset manner. Then, the user is to close the door to cover the opening to end the process of installing the toner container 51 into the toner container holding section 53.

The process of uninstalling the toner container 51 from the toner container holding section 53 is as follows. A user is to open the front door of the apparatus main assembly to expose the front end of the toner container holding section 53. As the opening is exposed, the toner container 51 in the toner container holding section 53, more specifically, the handhold section 72 of the toner container 51, which is the upstream end portion of the toner container 51 in terms of the toner container insertion direction, is exposed. Thus, the user is to grasp the handhold section 72, and slide the toner container 51 in the frontward direction X1 (uninstallation direction) while allowing the toner container 51 to be guided by the toner container guiding section 62, which is a part of the bottom section of the toner container holding section 53, in order to extract the toner container 51 from within the toner container holding section 53.

Figure 4:
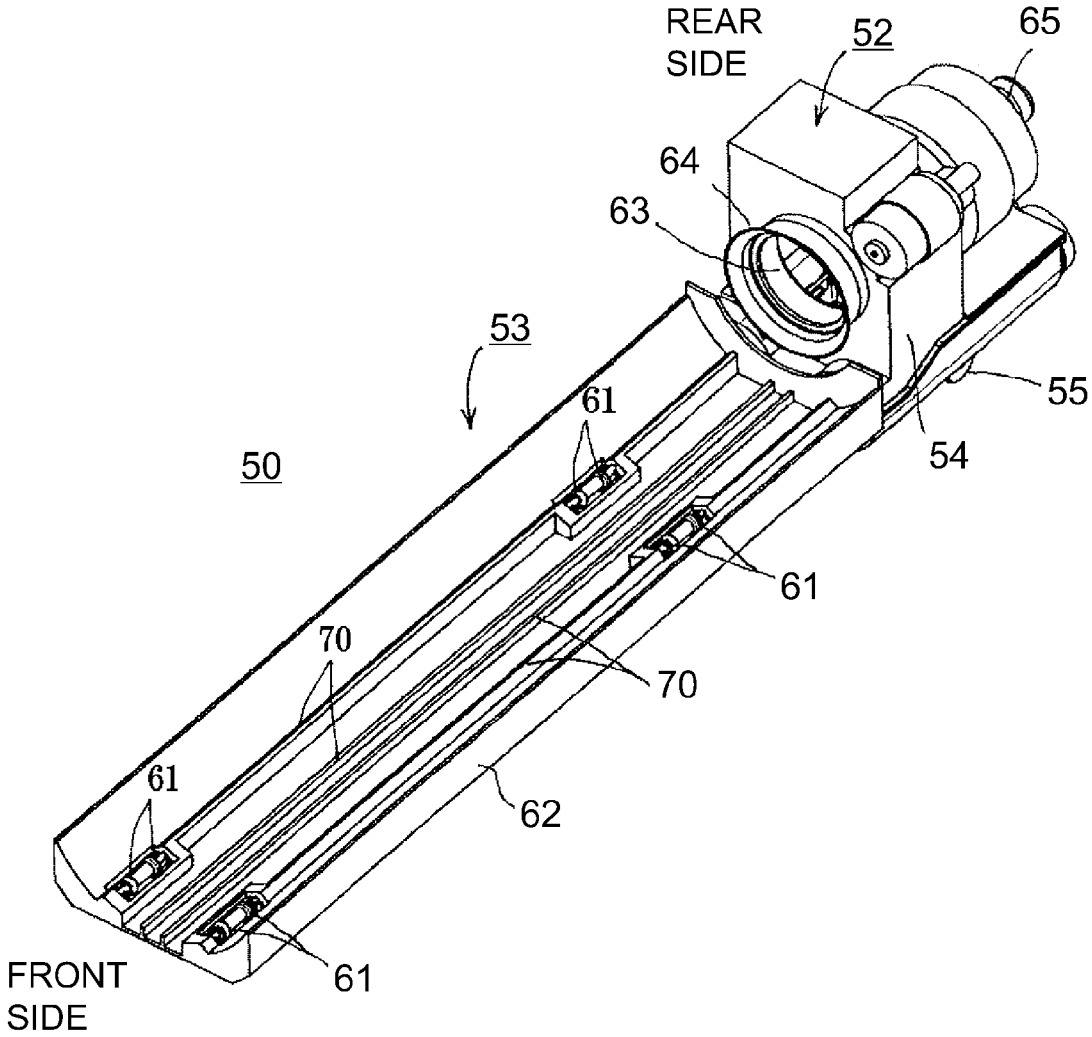
FIG. 4 is a perspective view of a comparative example of toner supplying section, when a toner container is not in the section.
Figure 5:
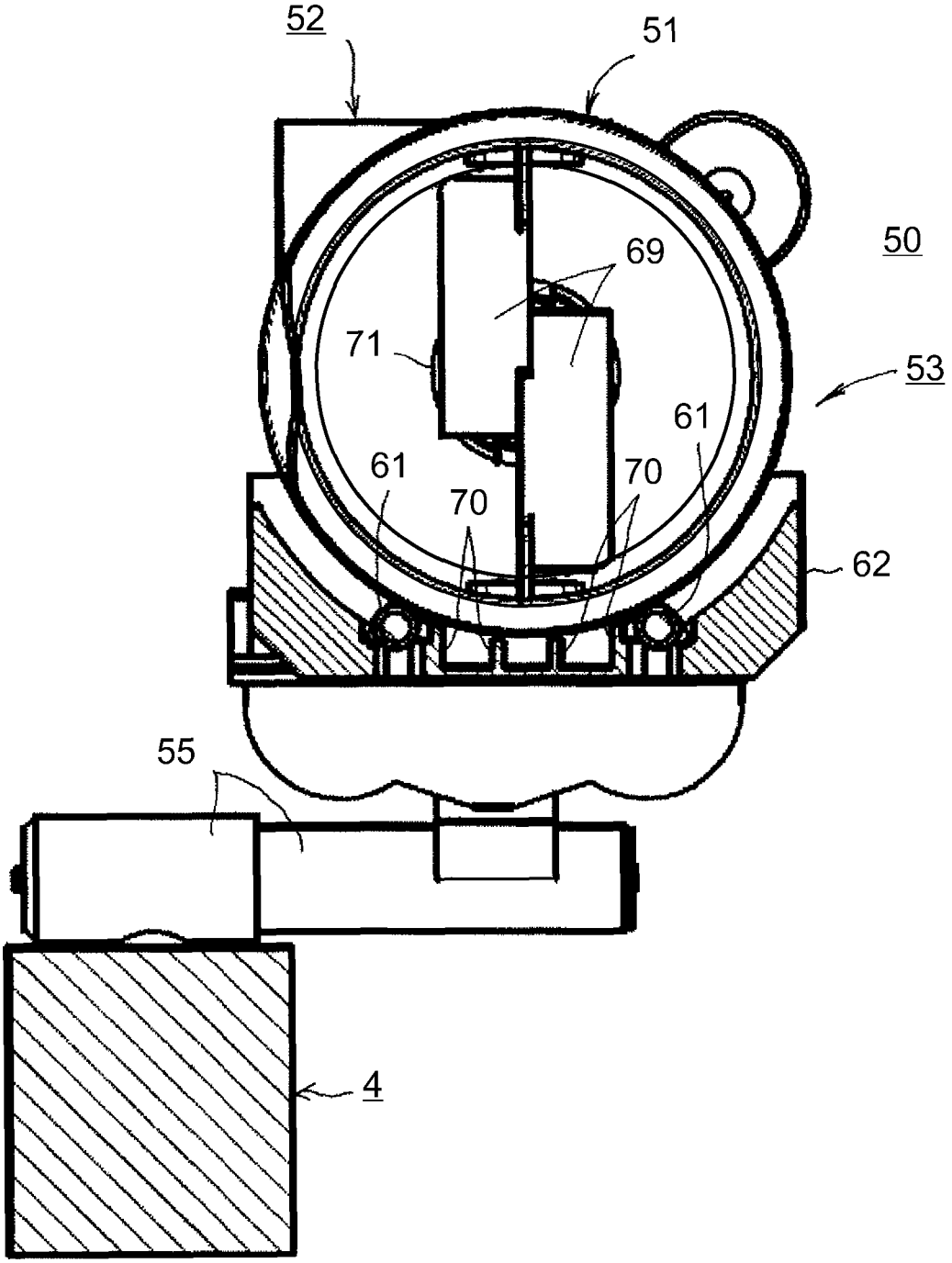
FIG. 5 is a sectional view of the toner supplying section, at a vertical plane which is perpendicular to the axial line of the toner container, as seen from the front side of the apparatus, when a toner container is in the section.

FIG. 4 is a perspective view of a combination of the toner container holding section 53 and toner reserving section 52, when the toner container 51 is not in the toner container holding section 53. FIG. 5 is a vertical sectional view of the combination of the toner container 51 and toner container holding section 53, at a vertical plane which is perpendicular to the axial line of the toner container 51. The toner container holding section 53 comprises four pairs of rollers 61, the toner container guiding section 62, and the toner inlet 63. The toner inlet 63 is on the front side of the toner reserving section 52.

The toner container holding section 53 comprises top, bottom, left and right toner container guiding sections, which are disposed in a manner to surround the toner container 51 when the toner container 51 is in the toner container holding section 53. The drawings show only the toner container guiding bottom section, which hereafter will be referred to simply as toner container guiding section 62. The four pairs of rollers are rotatably supported by the toner container guiding section 62. They support the toner container 51 in a manner to allow the toner container 51, which is cylindrical, to rotate about the axial line of the toner container 51 when the toner container 51 is in the toner container holding section 53.

The toner container holding section which is made up of the top, bottom, left, and right toner container guiding sections, is roughly cylindrical. Its internal diameter is 102 mm, which is slightly larger than the external diameter (100 mm) of the cylindrical toner container 51. The four pair of roller 61 are slightly (1 mm) protrusive from the inward surface of the toner container guiding section 62 of the toner container holding section, being enabled to prevent the toner container 51 and toner container guiding section 62 from rubbing each other when the toner container 51 in the toner container holding section 53 is rotated. Regarding the amount by which the four pairs of roller 61 protrude from the inward surface of the toner container guiding section 62, if it is excessive, it is difficult to install the toner container 51. Thus, it is desired to as small as possible.

The outward end of the toner inlet 63 is surrounded by a seal 64 to prevent toner from scattering from the toner inlet 63. There is provided a toner container driving section 65 on the inward side of the toner inlet 63 of the toner reserving section 52. The toner container driving section 65 is rotationally driven by a motor M (FIG. 14), with which the toner container 51 becomes coaxial as it is installed into the toner container holding section 53. The motor is under the control of the control circuit section 100.

The toner container driving section 65 is structured so that as the toner container 51 is inserted into the toner container holding section 53, the combination of the cylindrical toner outlet 71 and cap 66 of the toner container 51, which makes up the downstream end portion of the toner container 51 in terms of the toner container insertion direction X2, enters the toner reserving section 52 by a preset distance, through the toner inlet 63, and the cap 66 engages with the toner container driving section 65, enabling thereby the toner container driving section 65 to rotationally drive the toner container 51.

(2) Toner Container

Figure 8:
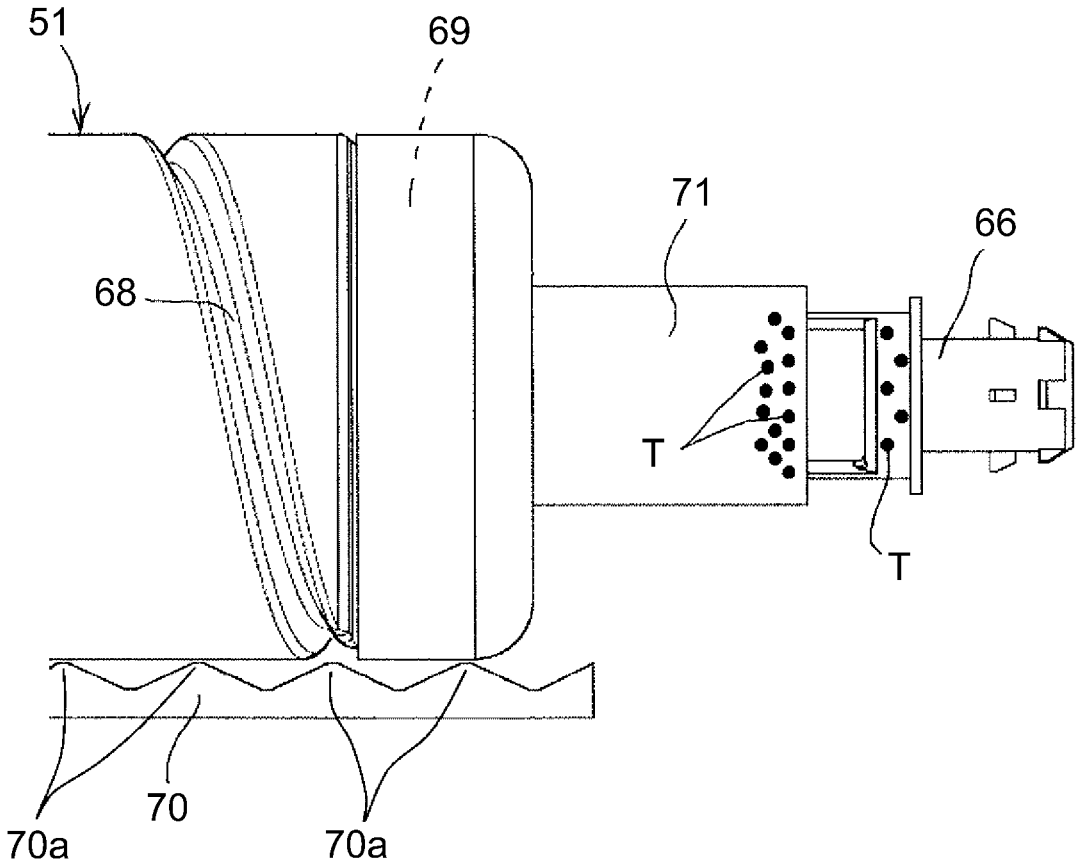
FIG. 8 is a schematic drawing for showing the toner particles on the cylindrical toner outlet, and cap, of the toner container.

Next, the toner container 51 is described. Referring to FIG. 2, in the case of the toner supplying device 50 in this embodiment, not only does the toner container 51 store toner, but also, it is given the function of conveying the toner therein. The toner container 51 is cylindrical. It is rotatable about its axial line when it is in the toner container holding section 53. Referring to FIGS. 3 and 8, the cylindrical toner outlet 71 of the toner container 51, which becomes the downstream end portion of the toner container 51 when the toner container 51 is inserted into the toner container holding section 53, is provided with the cap 66, which is unlocked by the cap unlocking mechanism, with which the toner reserving section 52 is provided (Japanese Laid-open Patent Application No. 2011-128230). Thus, it becomes possible for the toner in the toner container 51 to be discharged from the toner container 51 through the downstream end of the toner container 51 in terms of the toner container insertion direction.

The inward surface of the cylindrical wall of the toner container 51 is provided with a spiral rib 68, which spirally extends in the lengthwise direction of the toner container 51. Thus, as the toner container 51 is rotated, the toner in the toner container 51 is conveyed toward the cylindrical toner outlet 71 by the spiral rib 68. Further, the toner container 51 is provided with a pair of baffles, which are disposed in the toner container 51, next to the cylindrical toner outlet 71, to scoop up the toner in the toner container 51 to send the toner in the toner container 51 to the cylindrical toner outlet 71.

As for the cap 66, with which the outward end of the cylindrical toner outlet 71 is provided, its front end portion connects to the holder 67 of the toner container driving section 65, whereas the other end engages with the cylindrical toner outlet 71. Therefore, as the end of the cap 66 is rotated, the entirety of the toner container 51 rotates. As the entirety of the toner container 51 is rotated, the toner in the toner container 51 is gradually conveyed toward the cylindrical toner outlet 71. Then, it is discharged into the buffer section 54 of the toner reserving section 52.

(3) Toner Supplying Operation

Referring to FIGS. 1-3, after the toner container 51 is installed in the toner container holding section 53 in a preset manner, the control circuit section 100 drives the toner conveying section 55 in a preset manner in response to the sensor output inputted from the above-described sensor 101 or 102, with which the developing device 4 is provided. Thus, the toner in the buffer section 54 of the toner reserving section 52 is supplied to the developing device 4 by a necessary amount. At the same time, in order to supply toner to the buffer section 54, which has reduced in the amount of toner, the control circuit section 100 rotationally drives the toner container 51 by a preset amount, by driving the toner container driving section 65 in a preset manner, so that the toner in the toner container 51 is supplied to the buffer section 54 by a preset amount through the cylindrical toner outlet 71.

As the above-described toner supplying operation is continued, it is detected by a toner amount detecting means 103 (FIG. 14) whether the entirety of toner in the toner container 51 has been used up, or the amount of toner in the toner container 51 has reduced to a preset value. Then, the control circuit section 100 displays a message which prompts a user to replace the toner container 51 in the toner container holding section 53, or prepare a replacement toner container 51, in order to prepare the user to replace the toner container 51 in the toner container holding section 53 with a brand-new one. That is, the toner container in the toner container holding section 53 is replaced by a user each time the toner in the toner container 51 is used up.

(4) Countermeasure to Soiling of Toner Container

Figure 6:
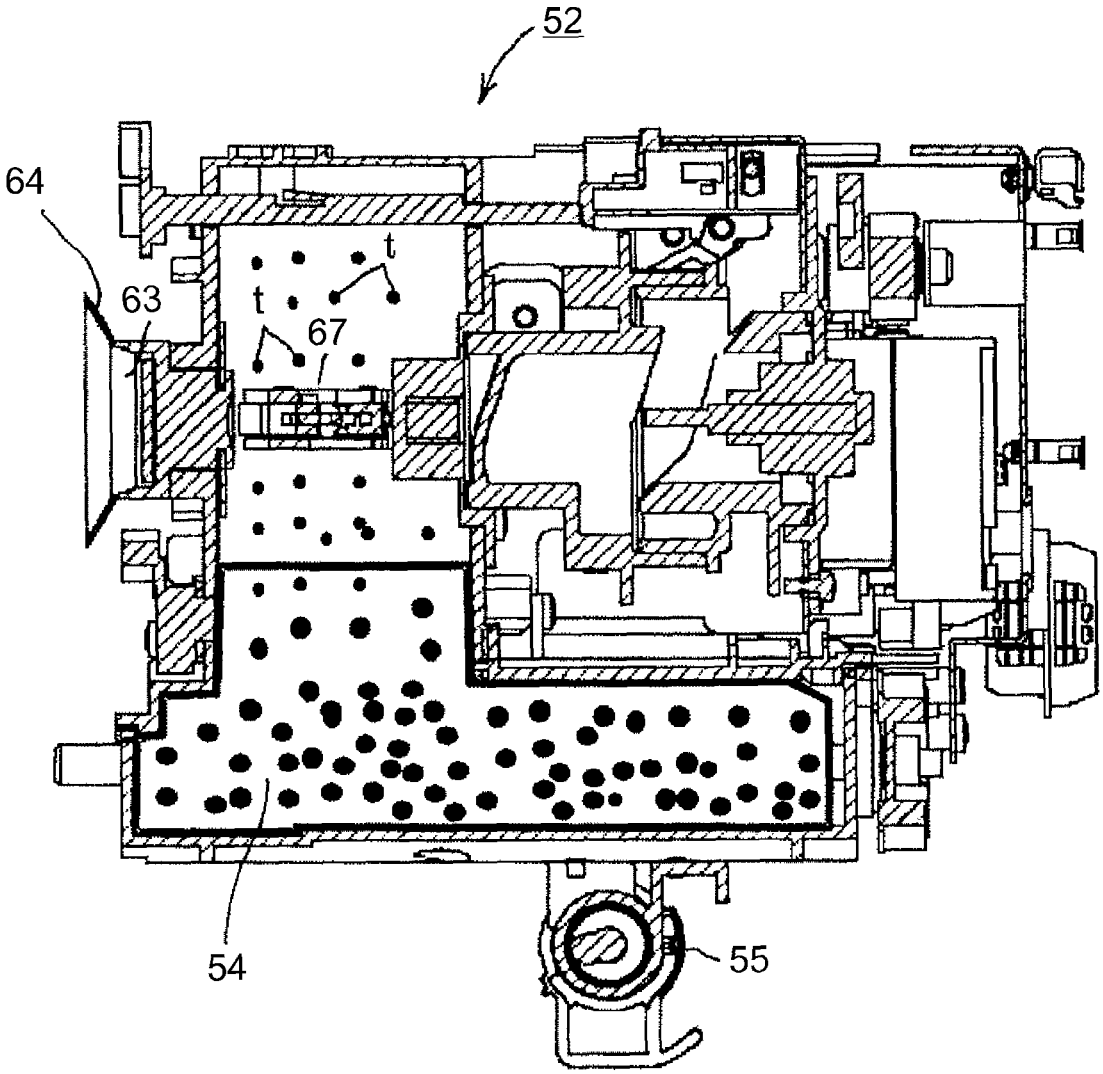
FIG. 6 is a sectional view of the toner supplying section, at a vertical plane which coincides with the rotational axis of the toner container, which is for showing the internal structure of the section.

The toner inlet 63 of the toner reserving section 52 is the section of the apparatus main assembly to which the toner container 51 is connected, and through which the toner in the toner container 51 is given to the apparatus main assembly. Therefore, it cannot be kept sealed while the toner container 51 in the toner container holding section 53 is replaced. Referring to FIG. 6, a small amount of toner (toner particles t) remains afloat in the toner reserving section 52. Therefore, as the toner container 51 in the toner container holding section 53 is pulled out of the toner container holding section 53 to be replaced, the toner particles t which are remaining afloat in the toner reserving section 52 sometimes come out of the toner reserving section 52 through the toner inlet 63, and scatter in the apparatus main assembly.

Further, when the toner container 51 is in the toner container holding section 53, the combination of the cylindrical toner outlet 71 and cap 66 of the toner container 51 will have been put in the toner reserving section 52 through toner inlet 63. Therefore, toner particles T will have adhered to the portions of the toner container 51, which is in the toner reserving section 52. Therefore, it sometimes occurs that as the cylindrical toner outlet 71 and cap 66 come out of the toner reserving section 52 through the toner inlet 63 when the toner container 51 is extracted from the toner container holding section 53 to be replaced, the toner particles T on the toner container 51 and cap 66 fall into the interior of the apparatus main assembly.

As the toner particles t and T scatter and/or fall in the apparatus main assembly, they accumulate on the toner container guiding section 62, which makes up the bottom section of the toner container holding section 53. The toner container guiding section 62 plays the role of guiding the toner container 51 when the toner container 51 in the toner container holding section 53 is replaced. Thus, if toner particles t and T accumulate on the toner container guiding section 62, it is possible that as a replacement toner container 51 is inserted into the toner container holding section 53, the toner on the toner container guiding section 62 will adhere to the peripheral surface of the replacement toner container 51. Moreover, if the toner particles t and T scatter and/or fall each time the toner container 51 in the toner container holding section 53 is replaced, the amount by which the peripheral surface of a replacement toner container 51 is soiled by the toner gradually increases, making it troublesome for a user to replace the toner container 51 in the toner container holding section 53.

Thus, the toner container guiding section 62, which holds the toner container 51 by the downwardly facing portion of the toner container 51, and allows the toner container 51 to slide in the toner container installation direction X2 or toner container extraction direction X1, in the toner container holding section 53, is provided with plain ribs, or undulatory ribs, that is, ribs having peaks and valleys, so that the downwardly facing portion of the peripheral surface of the toner container 51 is supported by the plain ribs (linear contact), or by the peaks of the undulatory ribs (point contact).

Referring to FIGS. 4 and 5, in the case of the first comparative example of toner container holding section 53, the inward surface of the toner container guiding section 62, which is the bottom section of the toner container holding section 53, is provided with multiple ribs 70 so that only the ribs 70 contact the peripheral surface (downwardly facing portion) of the toner container 51. Further, in terms of the side view, the portion of each rib 70, which comes in contact with the toner container 51, is shaped so that it looks like the cutting edge of a saw, in order to reduce in size the area of contact between the toner container 51 and toner container guiding rib to prevent the outward surface of the toner container 51 from being soiled by the toner on the ribs 70 of the toner container guiding section 62.

More concretely, the toner container guiding section 62 is structured so that each rib 70 extends in the direction which is parallel to the directions X2 and X1 in which toner container 51 is installed into, or uninstalled from the toner container holding section 53, respectively. In terms of the direction which is intersectional to the directions X1 and X2 (circumferential direction of toner container holding section), the multiple ribs 70 are disposed in parallel with the provision of preset intervals. Stray toner particles are likely to settle on the toner container guiding section 62, that is, the bottom one of the four sections of the toner container holding section. Thus, it is the toner container guiding section 62 that is provided with the four ribs 70. The four ribs 70 are positioned so that none of them are directly below the axial line of the toner container 51; they are positioned so that a pair of ribs 70 are roughly 10 mm offset from the center of the toner container guiding section 62, and the other pair is on the other side of the centerline, being offset roughly 10 mm from the centerline.

Further, with reference to the cross-sectional view of the toner container guiding section 62, an arc which coincides with the peaks of the rib 70 is 102 mm in diameter, which is slightly larger than the diameter (100 mm) of the toner container 51. Further, with reference to the inward surface of the toner container guiding section 62, the four pairs of rollers 61 which rotatably support the toner container 51 are slightly (1 mm) protrusive from the arc which coincides with the peaks of the rib 70.

As described above, by providing the toner container guiding section 62, which makes up the bottom section of the toner container holding section 53, with the four ribs 70, and distributing the four ribs 70 in such a manner that they will not be directly below the axial line of the toner container 51, as in this embodiment, it is possible to reduce the amount by which stray toner particles accumulate on the portions of the toner container guiding section 62, which come into contact with the toner container 51. Therefore, it is possible to prevent the problem that when the toner container 51 in the toner container holding section 53 is replaced, a replacement toner container is soiled by the toner on the toner container guiding section 62.

In the first embodiment, each rib 70 is shaped so that its toner container supporting ridge looks like the cutting edge of a saw (combination of alternately positioned peaks and valleys; notched rib). The downwardly facing portion of the peripheral surface of the toner container 51 is supported by the peak portions of the rib 70. That is, the rib 70 is shaped so that in terms of the lengthwise direction, multiple peaks and valleys are alternately positioned; its inwardly facing surface vertically undulates. In this embodiment, the amount by which each peak protrudes relative to the bottom of valley is no less than 1 mm, and no more than 10 mm. If the amount of protrusion is insufficient, the rib 70 is ineffective to prevent the toner container 51 from being soiled by the toner having settled on the toner container guiding section 62, whereas if the amount of protrusion is excessive, it is possible that an image forming apparatus will have to be increased in size, and/or the toner container guiding section 62 will be ineffective to guide the toner container 51. Further, in this embodiment, the interval between adjacent two peaks of the rib 70 was set to no less than 1 mm, and no more than 50 mm.

Figure 7:
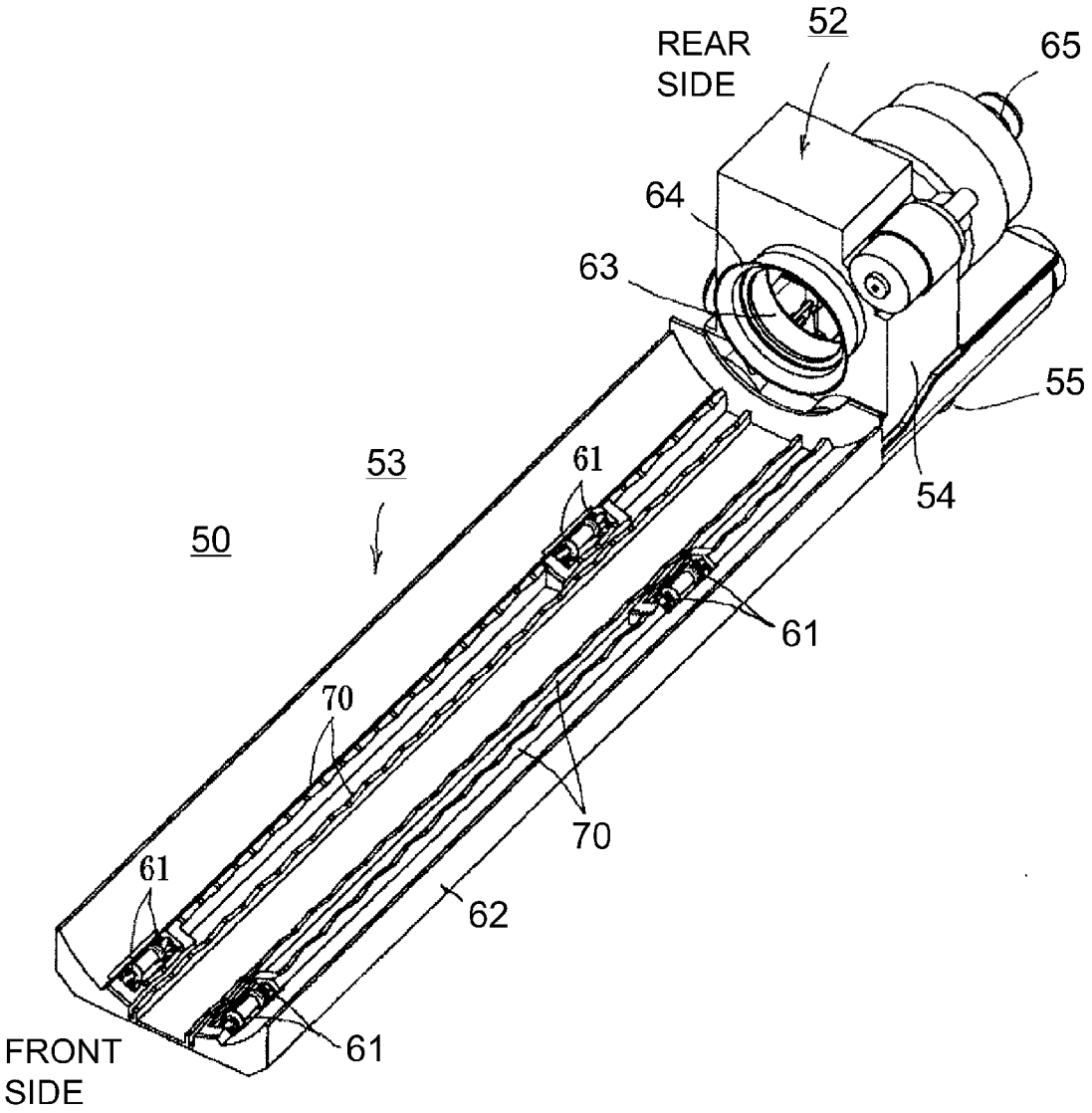
FIG. 7 is a perspective view of the toner supplying section in the first embodiment of the present invention (when toner container is not in section).

Referring to FIGS. 7 and 8, in this embodiment, the rib 70 is shaped as if it is formed by sequentially aligning multiple roughly triangular subsections 70*a* (shaped like mountains)

in the direction parallel to the directions X2 and X1 in which the toner container 51 is installed or uninstalled, respectively. Because the rib 70 is shaped as described above, the state of contact between the peripheral surface of the toner container 51 and the ribs 70 of the toner container guiding section 62 becomes so-called "point contact". Therefore, it is possible to reduce in size the area of contact between the rib 70 and toner container 51. Further, it becomes difficult for toner to accumulate on the portions of the rib 70, which come into contact with the toner container 51. Further, the concern that shaping the rib 70 as if it is formed by sequentially connecting roughly triangular subsections may have adverse effects upon the replaceability of the toner container 51 was taken into consideration. That is, the rib 70 is desired to be shaped so that in terms of the lengthwise direction of the rib 70, of the adjacent two peaks of the rib 70, one is slightly less in height than the other, so that the line which coincides with the peaks becomes tilted, or has curvature, relative to the lengthwise direction of the rib 70. Thus, the toner container holding section 53 in this embodiment is substantially more effective to prevent the soiling of the toner container 51 than the above-described first comparative example of toner container holding section.

Figure 15:
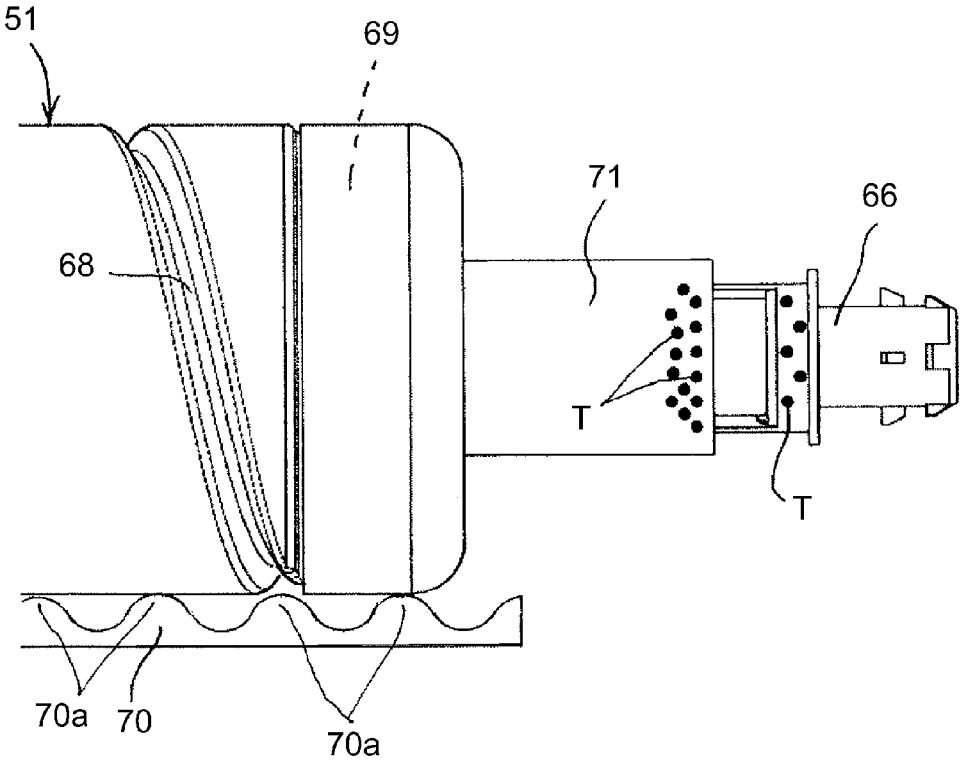
FIG. 15 is a side view of the toner outlet section of the modified version of the toner container shown in FIG. 8.

Referring to FIG. 15, the above-described subsection 70*a* of the rib 70 may be shaped so that its ridge forms an arc. Further, the rib 70 may be shaped as if it was formed by aligning, with the placement of preset intervals, multiple subsections 70*a* in the direction X2 or X1 in which the toner container 51 is moved when it is installed or uninstalled, respectively. Moreover, the guiding sections of the toner container guiding section 62 do not need to be in the form of a rib. For example, the surface of the toner container guiding section 62, which faces the toner container 51, may be provided with multiple pointed protrusions (so that state of contact between toner container 51 and protrusion becomes point contact), which are distributed in a preset pattern.

Also in this embodiment, the soiling of the outward surface of the toner container 51 is prevented by giving the toner container guiding section 62 of the toner container holding section 53, which makes up the bottom section of the toner container holding section 53, such a shape that reduces in size the area of contact between the toner container guiding section 62 and the outward surface of the toner container 51.

Embodiment 2

Figure 10:
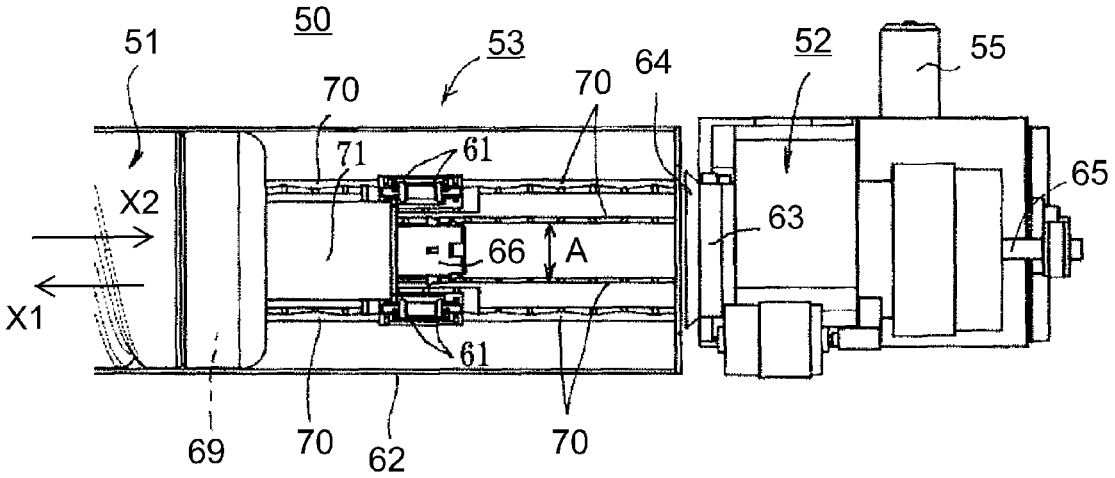
FIG. 10 is a top view of a part of the toner supplying section in the second embodiment.
Figure 11:
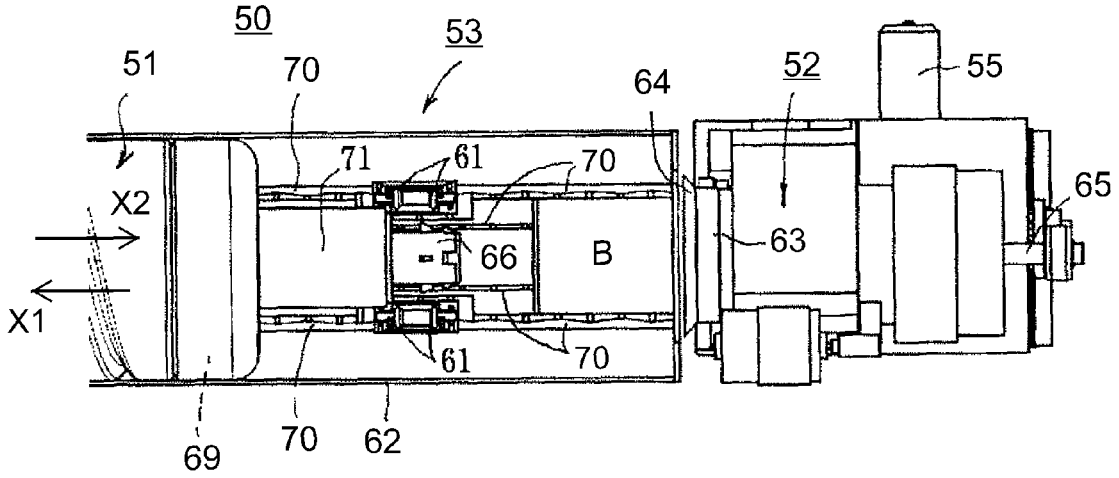
FIG. 11 is a top view of a part of the toner supplying section in the third embodiment.

The following description of this embodiment is related to the positioning of the ribs 70 in terms of the circumferential direction of the toner container guiding section 62, in the first comparative example of toner container holding section 53, and of the toner container holding section 53 in the first embodiment. Referring to FIGS. 8 and 10, the toner particles T having adhered to the cylindrical toner outlet 71 and cap 66 of the toner container 51 are highly likely to fall straight downward at the outward edge of the toner inlet 63, in a pattern, the width of which is equal to the width of the cylindrical toner outlet 71. Further, it is highly likely that the toner falls directly below the outward side of the toner inlet 63. As the toner falls, it adheres to the toner container guiding section 62 of the toner container holding section 53. Therefore, by not placing the ribs 70 on the area of the toner container guiding section 62 which is directly below the outward edge of the toner inlet 63, it is possible to more satisfactorily prevent the ribs 70 from being soiled by the toner.

Thus, the portion of the inward surface of the toner container guiding section 62, which is directly below the path which the cylindrical toner outlet 71 follows when the toner container 51 is installed or uninstalled in the directions X2 or X1, respectively, is not provided with rib 70, the ridge of which is undulatory. That is, the toner container guiding section 62 is structured so that there is no rib 70 on the area of the inward surface of the toner container guiding section 62, which is directly below the path which the cylindrical toner outlet 71 of the toner container 51 follows when the toner container 51 is guided by the ribs 70.

In the second embodiment, the cylindrical toner outlet 71 is 20 mm in width. Therefore, the width A between the pair of ribs 70 which are on the outward sides, one for one, of the area of the inward surface of the toner container guiding section 62, which is directly below the path of the cylindrical toner outlet 71, is set to 30 mm, as shown in FIG. 10.

Embodiment 3

The toner particles T on the cylindrical toner outlet 71 and cap 66 of the toner container 51 are likely to fall onto the inward surface of the toner container guiding section 62 of the toner container holding section 53 when the toner container 51 in the toner container holding section 53 is replaced. More specifically, it is on the immediate outward sides, in terms of the direction X1 in which the toner container 51 is extracted, of the area of the inward surface of the toner container guiding section 62, which is directly below the toner inlet 63, that the toner particles T are most likely to fall.

Figure 9:
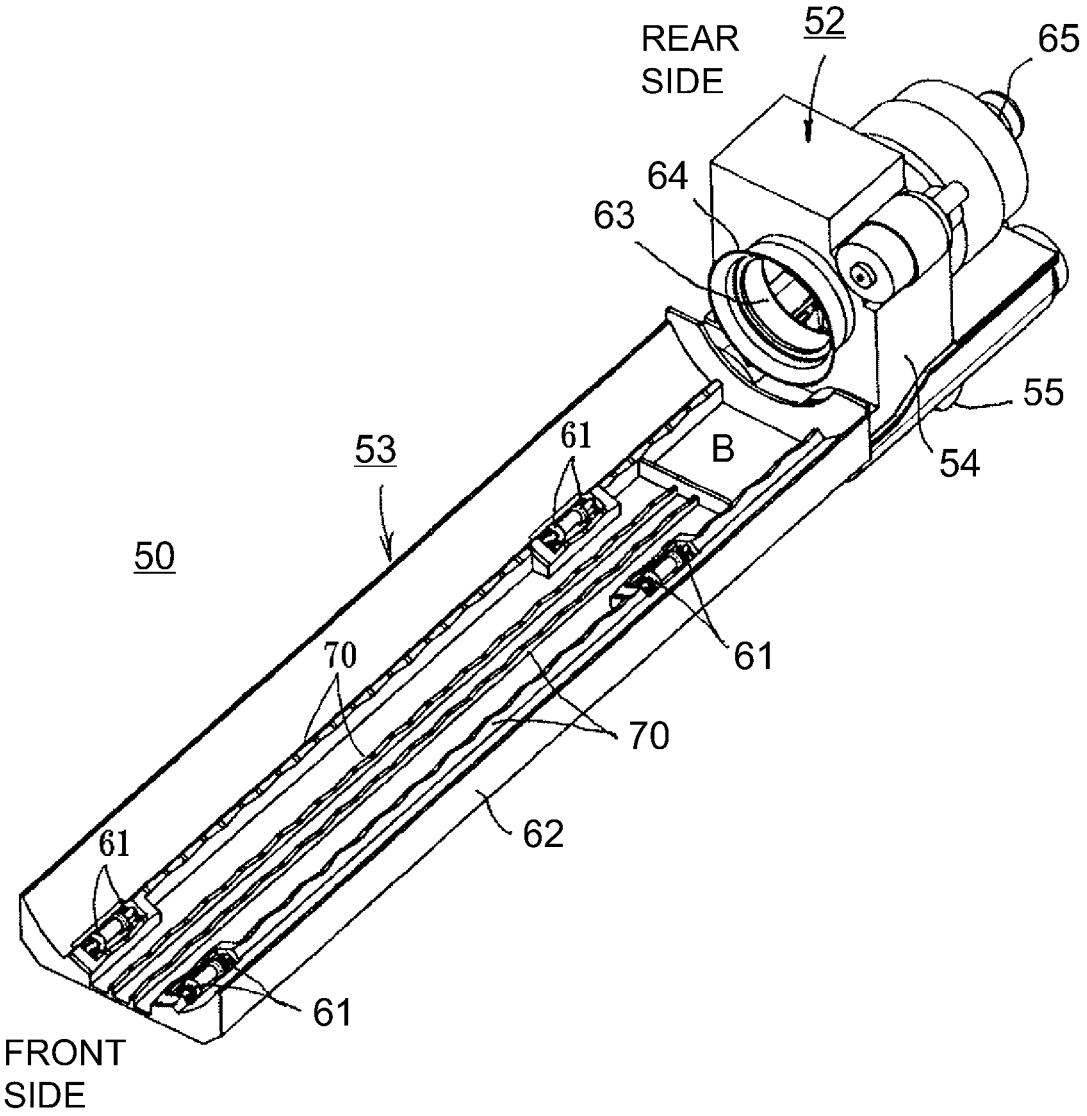
FIG. 9 is a perspective view of the toner supplying section in the third embodiment (when toner container is not in section).

Therefore, the areas of the inward surface of the toner container guiding section 62, which are on the immediate outside area of the inward surface of the toner container guiding section 62, which is directly below the toner inlet 63, are not provided with the ribs 70, or the like, the ridge of which is undulatory (having peaks and valleys). Referring to FIGS. 9 and 10, in the third embodiment, the toner container guiding section 62 is structured so that an area B, which is next to the toner inlet 63, in terms of the toner container extraction direction X1, when the toner container 51 is in the toner container guiding section 62, is not provided with the ribs 70 or the like. In this embodiment, the toner container guiding section 62 is provided with four ribs 70. However, the toner container guiding section 62 does not need to be structured so that all four ribs 70 will not be in the adjacencies of the toner inlet 63 when the toner container 51 is on the toner container guiding section 62. More specifically, in this embodiment, the toner container guiding section 62 is structured so that the middle two ribs 70 do not extend through the area of the toner container guiding section 62, which is next to the toner inlet 63. That is, in this embodiment, the toner container guiding section 62 is structured so that at least the middle two ribs 70, in terms of the widthwise direction of the toner container guiding section 62, which is intersectional to the toner container installation direction, do not overlap with the toner inlet 63, in terms of the lengthwise direction of the ribs 70.

In this embodiment, the area B, across which the ribs 70 are not to extended, is given a length of 100 mm. However, in consideration of the ease with which the toner container 51 in the toner container holding section 53 can be replaced, the length of the area B is desired to be roughly ¼ of the entire length of the toner container 51.

Embodiment 4

In the forgoing description of the first to third embodiments, focus was on the toner supplying device 50. However, the present invention is also applicable to other sections of the image forming apparatus, onto which toner may scatter or fall, and which are to be replaced and/or maintained by a user or a service person.

Figure 12:
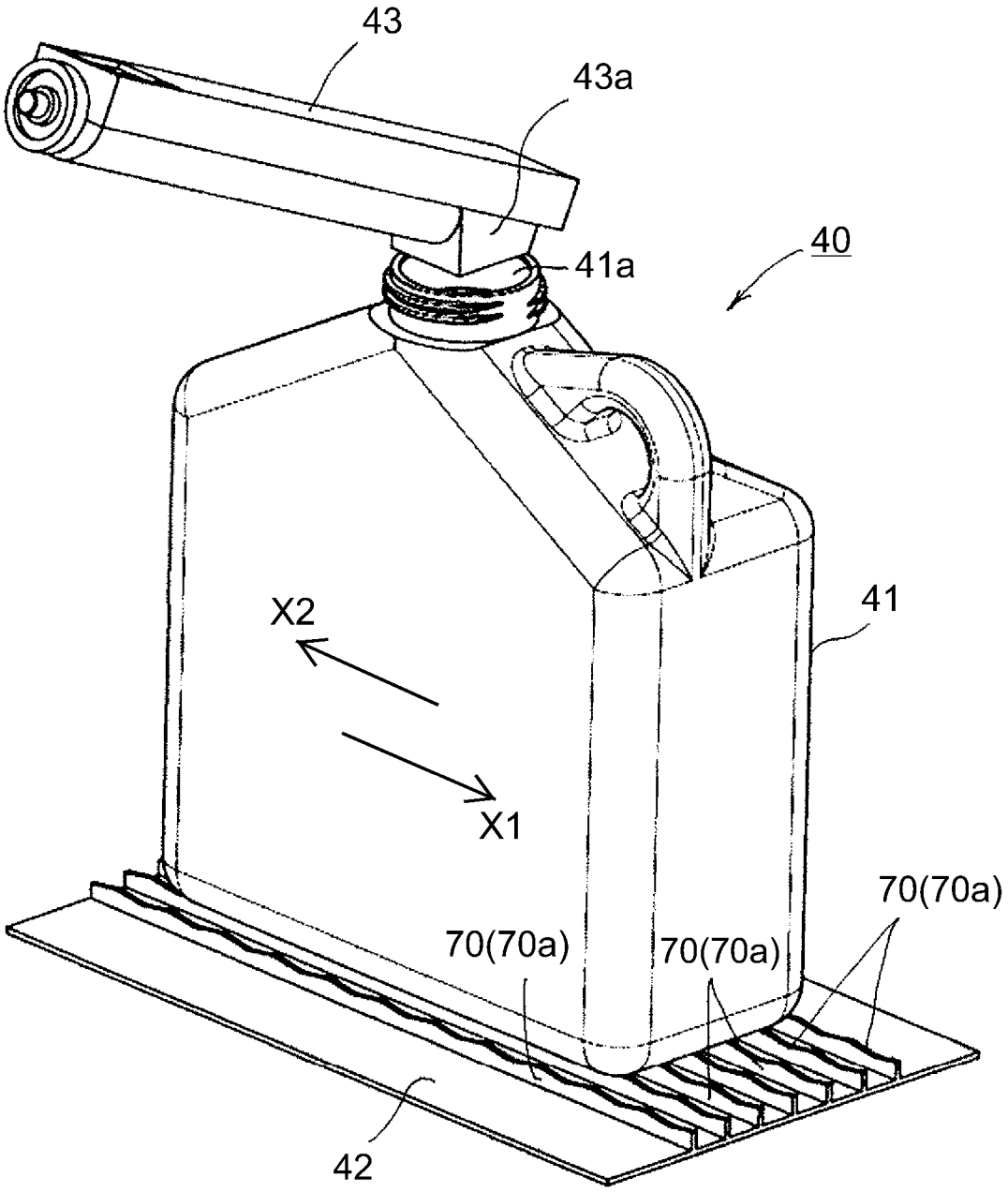
FIG. 12 is a perspective view of the sections of the image forming apparatus in the fourth embodiment, which are related to the present invention.
Figure 13:
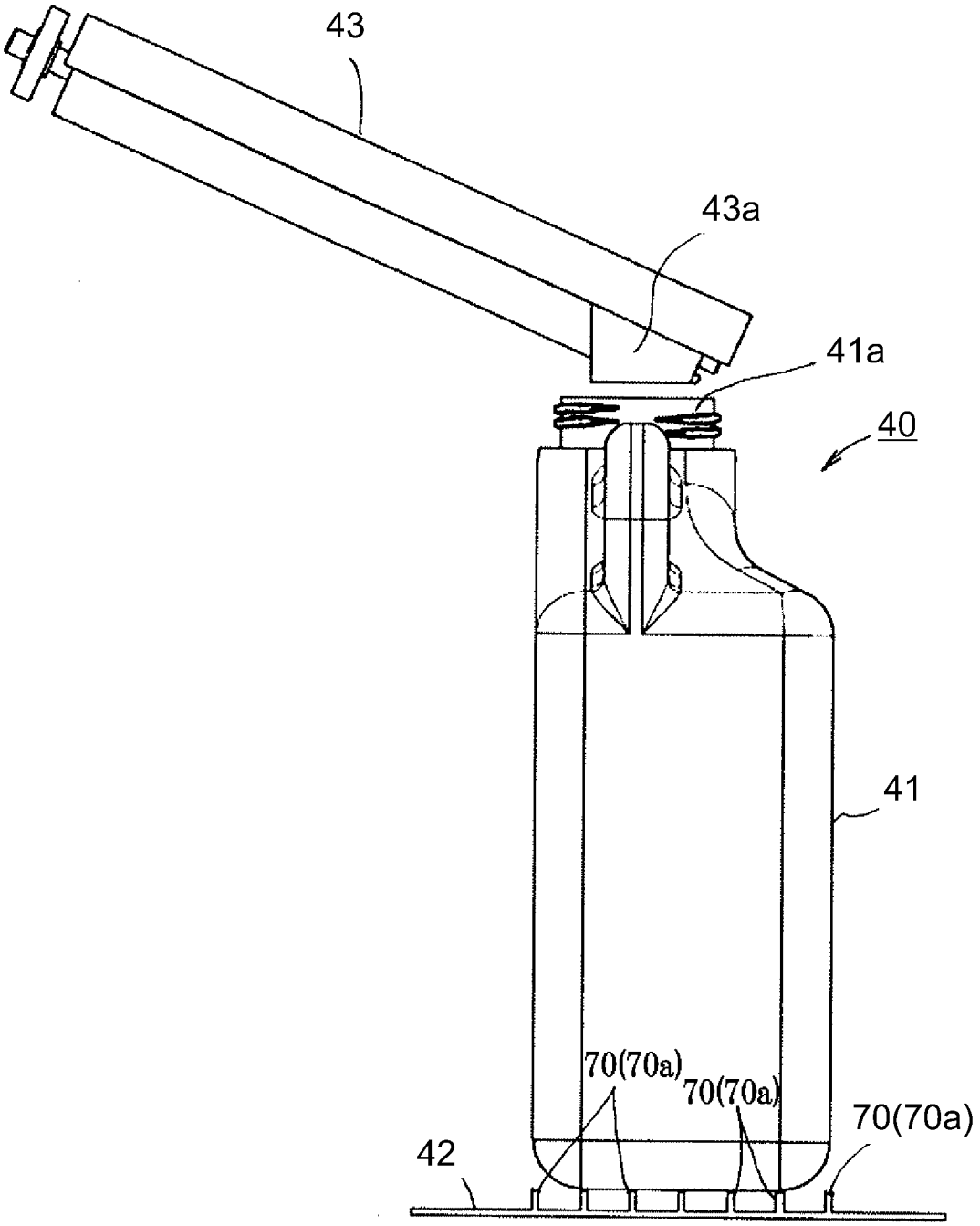
FIG. 13 is a front view of the sections of the image forming apparatus in the fourth embodiment, which are related to the present invention.

Referring to FIGS. 12 and 13, in the fourth embodiment, the present invention is applied to a section (toner container holding section) of an image forming apparatus, in which a waste toner container 41, that is, a container in which recovered toner is stored, is held. Some waste toner containers 41 are to be replaced by an ordinary user, whereas the other are to be replaced by a professional service person, although whether the waste toner container 41 is to be replaced by an ordinary user or professional service person depends on the configuration of an image forming apparatus. The waste toner container 41 is held in the main assembly of an image forming apparatus in order to store the waste toner, such as transfer residual toner, which is generated by an image forming process, and/or old (deteriorated) developer.

The waste toner container 41 is installed into the apparatus main assembly so that it is placed on the inward surface of the bottom wall of the waste toner container guiding section (toner container guiding section) of the waste toner container holding section 40, to be positioned in a preset manner. After the waste toner container 41 is installed as described above, the toner inlet opening (first opening) of the waste toner container 41, which faces upward, is directly below the downwardly facing toner outlet 43*a*. That is, the toner inlet opening 41*a* is in connection to the toner outlet opening 43*a*.

In this embodiment, the toner inlet opening 41*a* is larger than the toner outlet opening 43*a*. Thus, as the waste toner is conveyed by the waste toner conveying device 43 to the toner outlet opening 43*a*, it falls into the waste toner container 41 through the toner inlet opening 41*a*, and collects in the waste toner container 41.

The apparatus main assembly is provided with a sensor 105 (FIG. 14) which detects whether or not the waste toner container 41 is full. As the waste toner container 41 becomes full, the sensor 105 sends a signal which indicates that the waste toner container 41 is full, to the control circuit section 100. As the control circuit section 100 receives the signal, it displays a message which indicates that the waste toner container 41 is full, on the display 104. Then, the waste toner container 41 is to be replaced by a user or a service person, in response to the message on the display 104.

Regarding the extraction of the waste toner container 41 from the waste toner container holding section 40, the waste toner container 41 can be pulled out in the extraction direction X1 by a user or a service person. As the waste toner container 41 is pulled in the extraction direction X1, it comes out sliding on the ribs 70 on the inward surface 42 of the waste toner container holding section. As for the installation of the waste toner container 41 into the waste toner container holding section 40, first, the user or service person is to rest the waste toner container 41 on the ribs 70 of the waste toner container holding section, and then, to push the waste toner container 41 in the installation direction X2 to cause the waste toner container 41 to slide on the ribs 70 until its movement is regulated by a stopping component.

Like the toner container 51, the waste toner container 41 is also shorter in life expectancy than the apparatus main assembly. Therefore, it is replaced each time it becomes full of waste toner. Further, as it is possible that the toner container holding section 40 is soiled by the toner particles having scattered or fallen from the toner outlet opening 43*a* when the toner container 41 is replaced, it is possible that the waste toner container holding section 40 will be soiled by the toner particles having scattered or fallen from the toner outlet opening 43*a* of the waste toner conveying device 43, when the waste toner container 41 is replaced. Therefore, it is possible to prevent the downwardly facing portion, or the like portion, of the waste toner container 41, from being soiled by waste toner, by providing the upwardly facing surface 42 of the waste toner container holding section 40, by which the waste toner container 41 is held, with ribs or rib-like protrusions which are similar to those in the first to third embodiments. Therefore, it is possible to improve an image forming apparatus in terms of the replaceability of its waste toner container.

According to the present invention, it is possible to provide an image forming apparatus which can more satisfactorily prevent a toner container from being soiled by toner, and yet, is less expensive in terms of structure, better in appearance, and easier to operate than any conventional image forming apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-054467 filed on Mar. 18, 2015, which is hereby incorporated by reference herein in its entirety.

What is claimed is:

1. An image forming apparatus comprising:

a mounting portion on which a developer container provided with an accommodating portion configured to accommodate developer is mountable;

a drive input portion configured to input a driving force for rotating the developer container mounted in said mounting portion, to the developer container; and a developer receiving portion for receiving developer discharged from the developer container by the rotation thereof, wherein said mounting portion is provided with a rib extending in a dismounting direction, in which the developer container is dismounted from said mounting portion, said rib being configured to guide a bottom portion of the developer container in the dismounting direction, and said rib including a plurality of sets of alternating peaks and valleys arranged along a longitudinal direction of said rib, and heights of the peaks as measured from the valleys are not less than 1 mm and not more than 10 mm.

2. The image forming apparatus according to claim 1, wherein an interval between adjacent peaks is not less than 1 mm and not more than 50 mm.

3. The image forming apparatus according to claim 1, wherein heights of adjacent peaks gradually change along the longitudinal direction of said rib.

4. The image forming apparatus according to claim 1, wherein said rib is provided so as not to be right below a movement path of an opening of the developer container when the developer container is guided by said rib.

5. The image forming apparatus according to claim 1, wherein a plurality of such ribs is provided, and said ribs are provided at different positions with respect to a direction crossing with a mounting direction of the developer container, and a gap is provided between adjacent ribs.

6. The image forming apparatus according to claim 1, wherein a plurality of such ribs is provided, and said ribs are provided at different positions with respect to a direction crossing with a mounting direction of the developer container, a gap is provided between adjacent ribs, and at least a part of each of said ribs is provided at a position not overlapping with an opening of said image forming apparatus with respect to the longitudinal direction of said ribs.

7. The image forming apparatus according to claim 1, wherein the valleys of said rib are out of contact with the developer container when the developer container is mounted to said mounting portion.

8. The image forming apparatus according to claim 1, further comprising a rotatable supporting portion configured to support the developer container mounted to said mounting portion.

9. The image forming apparatus according to claim 8, wherein said rotatable supporting portion is provided so that said rib does not contact the developer container when the developer container is mounted to said mounting portion.

10. An image forming apparatus comprising:

a mounting portion on which a developer container provided with an accommodating portion configured to accommodate developer is mountable;

an image forming portion for forming an image on a recording material; and a discharge opening for discharging, into the developer container, developer discharged from said image forming portion, wherein said mounting portion is provided with a rib extending in a dismounting direction, in which the developer container is dismounted from said mounting portion, said rib being configured to guide a bottom portion of the developer container in the dismounting direction, and said rib including a plurality of sets of alternating peaks and valleys arranged along a longitudinal direction of said rib, and heights of the peaks as measured from the valleys are not less than 1 mm and not more than 10 mm.

11. The image forming apparatus according to claim 10, wherein an interval between adjacent peaks is not less than 1 mm and not more than 50 mm.

12. The image forming apparatus according to claim 10, wherein heights of adjacent peaks gradually change along the longitudinal direction of said rib.

13. The image forming apparatus according to claim 10, wherein said rib is provided so as not to be right below a movement path of an opening of the developer container when the developer container is guided by said rib.

14. The image forming apparatus according to claim 10, wherein a plurality of such ribs is provided, and said ribs are provided at different positions with respect to a direction crossing with a mounting direction of the developer container, and a gap is provided between adjacent ribs.

15. The image forming apparatus according to claim 10, wherein a plurality of such ribs is provided, and said ribs are provided at different positions with respect to a direction crossing with a mounting direction of the developer container, a gap is provided between adjacent ribs, and at least a part of each of said ribs is provided at a position not overlapping with an opening of said image forming apparatus with respect to the longitudinal direction of said ribs.

16. The image forming apparatus according to claim 10, wherein said rib supports the developer container mounted to the mounting portion.

17. An image forming apparatus comprising:

a mounting portion on which a developer container provided with an accommodating portion configured to accommodate developer is mountable;

a drive input portion configured to input a driving force for rotating the developer container mounted in said mounting portion, to the developer container; and a developer receiving portion for receiving developer discharged from the developer container by the rotation thereof, wherein said mounting portion is provided with a rib, provided on said mounting portion at a position below a level of a rotational axis of the developer container and extending in a dismounting direction, in which the developer container is dismounted from said mounting portion, said rib being configured to guide the developer container in the dismounting direction, and said rib including a plurality of sets of alternating peaks and valleys arranged along a longitudinal direction of said rib, and heights of the peaks as measured from the valleys are not less than 1 mm and not more than 10 mm.

18. The image forming apparatus according to claim 17, wherein an interval between adjacent peaks is not less than 1 mm and not more than 50 mm.

19. The image forming apparatus according to claim 17, wherein heights of adjacent peaks gradually change along the longitudinal direction of said rib.

20. The image forming apparatus according to claim 17, wherein said rib is provided so as not to be right below a movement path of an opening of the developer container when the developer container is guided by said rib.

21. The image forming apparatus according to claim 17, wherein a plurality of such ribs are provided, and said ribs is provided at different positions with respect to a direction crossing with a mounting direction of the developer container, and a gap is provided between adjacent ribs.

22. The image forming apparatus according to claim 17, wherein a plurality of such ribs is provided, and said ribs are provided at different positions with respect to a direction crossing with a mounting direction of the developer container, a gap is between adjacent ribs, and at least a part of each of said ribs is provided at a position not overlapping with an opening of said image forming apparatus with respect to the longitudinal direction of said ribs.

23. The image forming apparatus according to claim 17, wherein the valleys of said rib are out of contact with the developer container when the developer container is mounted to said mounting portion.

24. The image forming apparatus according to claim 17, further comprising a rotatable supporting portion configured to support the developer container mounted to said mounting portion.

25. The image forming apparatus according to claim 24, wherein said rotatable supporting portion is provided so that said rib does not contact the developer container when the developer container is mounted to said mounting portion.

* * * * *